US005782235A

United States Patent [19]

Müller et al.

[11] Patent Number: 5,782,235

[45] Date of Patent: Jul. 21, 1998

[54] VALVED FILTER CONNECTION PIECE FOR A GAS MASK

[75] Inventors: Rüdiger Müller, Stockelsdorf; Hartmut Kintzel, Lübeck, both of Germany

[73] Assignee: Drägerwerk AG, Lübeck, Germany

[21] Appl. No.: 806,834

[22] Filed: Feb. 25, 1997

[30] Foreign Application Priority Data

Mar. 5, 1996 [DE] Germany ..... 196 08 412.1

[51] Int. Cl.[6] ..... A62B 7/10; A62B 18/08; A62B 23/02; A62B 9/04

[52] U.S. Cl. ..... 128/206.15; 128/206.17; 128/202.27

[58] Field of Search ..... 128/202.22, 202.27, 128/205.23, 206.16, 206.17, 205.25, 206.15

[56] References Cited

U.S. PATENT DOCUMENTS

| | | | |
|---|---|---|---|
| 4,453,544 | 6/1984 | Silverthorn | 128/206.17 |
| 4,592,350 | 6/1986 | Maryyanek et al. | 128/206.17 |
| 4,832,018 | 5/1989 | Pantaleon-Stemberg | 128/206.17 |
| 5,154,168 | 10/1992 | Schlobohm | 128/206.16 |

FOREIGN PATENT DOCUMENTS

| | | | |
|---|---|---|---|
| 748 953 | 1/1944 | Germany . | |
| 102415 | 6/1963 | Norway | 128/206.17 |
| 354612 | 8/1931 | United Kingdom | 128/206.17 |

*Primary Examiner*—Kimberly L. Asher
*Attorney, Agent, or Firm*—McGlew and Tuttle

[57] ABSTRACT

A combination of a first breathing connection of a gas mask with an insert which can be inserted into the breathing connection for connecting filters to the gas mask is to be improved in terms of the simple manufacture of country-specific variants of gas masks. The insert has a first marking field belonging to a first fastening means on a surface located outside the breathing connection.

12 Claims, 1 Drawing Sheet

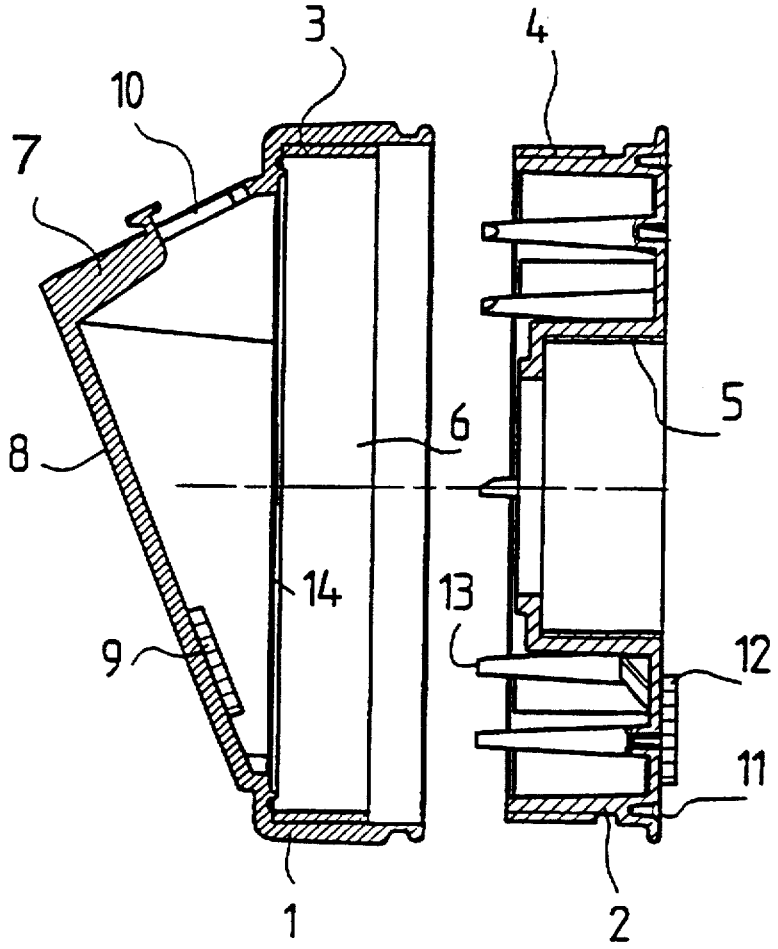
3
4
10
7
5
6
8
14
13
9
12
11
1
2

VALVED FILTER CONNECTION PIECE FOR A GAS MASK

FIELD OF THE INVENTION

The present invention pertains to a combination of a breathing connection of a gas mask with a connection piece which can be inserted into the breathing connection for connecting filters to the gas mask, wherein a first fastening device is provided within the insert, and a second fastening device is provided between the breathing connection and the insert.

BACKGROUND OF THE INVENTION

A gas mask has been known from DE-PS 748 953, in which respirator filters or oxygen respirators can be optionally connected to the gas mask by means of interchangeable inserts, which are screwed into the breathing connection. The inserts have identical external threads, which are screwed into the breathing connection, and correspondingly adapted internal threads for connection of the respirator filter or of the oxygen respirator.

Based on national and international regulations, it is necessary to design gas masks for different connection systems, especially for different types of filters. Thus, the filter connection RD 91 is standardized on the market of the European Community, while the so-called RD 40 filter connection is specified in other countries. Corresponding masks have been manufactured until now for each filter connection, namely, a first version with RD 91 round thread and various second versions with RD 40 round thread on the breathing connection. Corresponding to the thread on the breathing connection, the gas masks must be marked differently. This marking is obtained from permit numbers and test codes, which are to be correspondingly shown on the gas mask. The situation is made more difficult by the fact that there are different permits for the RD 40 round thread connection in individual countries, which require a country-specific marking. Consequently, a great variety of types of gas masks must be stocked because of the different filter connections alone.

SUMMARY AND OBJECTS OF THE INVENTION

The primary object of the present invention is to improve a gas mask such that country-specific types of masks can be manufactured in a simple manner.

This object is accomplished by the insert located in the breathing connection having a marking field belonging to the first fastening means on a surface located outside the breathing connection.

The advantage of the present invention is essentially that a plurality of mask types can be prepared based on the insert and the marking field located on the insert. Thus, the permit numbers pertaining to the country in question can be applied to the marking field, and different variants can be manufactured with one basic type of gas mask in such a way that the corresponding inserts are inserted into the breathing connection.

It is especially advantageous to provide within the breathing connection a second marking field, which belongs to the second fastening means of the breathing connection, is at least partially covered by the insert, and on which the type designation of the gas mask is indicated when the insert is missing (or removed).

The second marking field is advantageously located on a housing surface which is arranged opposite the breathing gas opening of the breathing gas connection. The housing surface may be flat or concave or convex.

It is especially advantageous to design the first fastening means at the insert as an RD 40 round thread and the second fastening means at the breathing connection as an RD 91 round thread, and to provide the marking for the RD 40 round thread connection on the first marking field at the insert, and to use the second marking field within the breathing connection for the RD 91 round thread.

Since the RD 91 round thread connection is used only for gas masks within the European Community, which has a standard permit marking, all gas masks with RD 91 round thread connection can be manufactured with one gas mask basic body. A gas mask with RD 40 round thread connection is obtained by inserting the insert with the RD-40 round thread connection into the breathing connection. The second marking field within the breathing connection is covered by the insert, and only the first marking field is visible, which is located at the insert. If country-specific gas masks are to be manufactured with an RD 40 round thread connection, only another insert with the corresponding permit marking on the first marking field is inserted into the breathing connection. All necessary types of gas masks can thus be manufactured by means of a standard gas mask basic body and different inserts.

One exemplary embodiment is shown in the figure and will be explained in greater detail below.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE is a sectional view of showing the parts which are to be connected according to the invention.

DESCRIPTION OF THE PREFERRED EMBODIMENT

Referring to the drawing in particular, the only figure shows a longitudinal section of a breathing connection 1 of a gas mask. The gas mask is not shown in the figure. An insert 2 is inserted into the breathing connection 1. At its breathing gas opening 6, the breathing connection 1 has an RD 91 internal thread 3, into which an external thread 4 located on the insert 2 can be screwed. An RD 40 connection thread 5 for fastening an RD 40 respirator filter, not shown in the figure, is provided in the middle of the insert 2. The RD 91 internal thread 3 on the breathing connection is used to screw in a respirator filter with RD 91, not shown in the figure. The rear part of the breathing gas opening 6 is closed with a housing 7, which has a flat housing surface 8. Via a breathing gas opening 6 and an opening 10 in the housing 7, the breathing gas enters an interior space of the gas mask, not shown in the figure. A first marking field 12 is arranged on a front side 11 of the insert 2, which front side partially covers the breathing connection 1 against the environment. The first marking field 12 contains the mask-specific permit numbers for the RD 40 round thread connection. A second marking field 9 is provided on the housing surface 8 within the breathing connection 1. A permit number, which belongs to the RD 91 round thread connection, is located on the second marking field 9. If a gas mask with an RD 91 round thread connection is needed, the gas mask is used without the insert 2, and the permit number is directly visible for the user on the second marking field 9. A gas mask with an RD 40 round thread connection is obtained by screwing the insert 2 into the breathing connection 1. The permit number belonging to the RD 40 round thread connection is recognizable on the first marking field 12. Country-specific variants of the RD 40 round thread connection can be obtained by using different inserts 2 by entering the permit or code number belonging to the corresponding country in the first marking field 12. To fix the insert 2 within the breathing connection 1, tongue-like catch springs 13, which point toward the housing 7 and engage corresponding webs 14 located on the breathing connection and thus lock the insert 2 in relation to the breathing connection 1, are provided on the insert 2. A subsequent replacement of the insert 2 is thus prevented.

While specific embodiments of the invention have been shown and described in detail to illustrate the application of the principles of the invention, it will be understood that the invention may be embodied otherwise without departing from such principles.

What is claimed is:

1. A gas mask breathing connection and insert which can be inserted into the said breathing connection for connecting filters to the gas mask, comprising:

a first fastening means provided within said insert;

a second fastening means provided between said breathing connection and said insert; and a first marking field associated with said first fastening means disposed on a surface of said insert, located outside said breathing connection.

2. The gas mask breathing connection and insert in accordance with claim 1, wherein said breathing connection has a second marking field, which is at least partially covered by said insert, said second marking field being associated with said second fastening means, said second fastening means being designed to receive an additional filter with said insert removed.

3. The gas mask breathing connection and insert in accordance with claim 2, wherein said second marking field is arranged on a housing surface located opposite said breathing gas opening of said breathing connection.

4. The gas mask breathing connection and insert in accordance with claim 1, wherein said surface containing said first marking field of said insert is a front side of the said insert facing away from said breathing connection.

5. The gas mask breathing connection and insert in accordance with claim 1, further comprising: a catch locking said insert within said breathing connection, said catch being provided between said breathing connection and said insert.

6. The gas mask breathing connection and insert in accordance with claim 1, wherein said first fastening means is an RD 40 round thread, and said second fastening means is an RD 91 round thread.

7. A method of providing a gas mask breathing connection system, comprising the steps of:

providing a gas mask with a breathing connection;

providing an insert which can be inserted into said breathing connection for connecting filters to the gas mask;

providing a first fastening means within said insert;

providing a second fastening means between said breathing connection and said insert;

providing a first marking field associated with said first fastening means disposed on a surface of said insert, located outside said breathing connection;

inserting said insert into said breathing connection to provide a connection to a filter via said first fastening means, or maintaining said insert out of said breathing connection to provide a connection to a filter via said second fastening means.

8. The method in accordance with claim 7, further comprising providing said breathing connection with a second marking field, which is at least partially covered by said insert, said second marking field being associated with said second fastening means, said second fastening means being designed to receive an additional filter with said insert removed.

9. The method in accordance with claim 8, wherein said second marking field is arranged on a housing surface located opposite said breathing gas opening of said breathing connection.

10. The method in accordance with claim 7, wherein said surface containing said first marking field of said insert is a front side of the said insert facing away from said breathing connection.

11. The method in accordance with claim 7, further comprising: fixing said insert in said breathing connection with a catch locking said insert within said breathing connection, said catch being provided between said breathing connection and said insert.

12. The method in accordance with claim 7, wherein said first fastening means is an RD 40 round thread, and said second fastening means is an RD 91 round thread.

* * * * *